US010945546B2

(12) United States Patent
Holschumacher et al.

(10) Patent No.: US 10,945,546 B2
(45) Date of Patent: Mar. 16, 2021

(54) DRINKING ATTACHMENT FOR A DRINKING VESSEL AND DRINKING VESSEL WITH SUCH ATTACHMENT

(71) Applicant: MAPA GMBH, Zeven (DE)

(72) Inventors: Ralf Holschumacher, Zeven (DE); Eckhard Itzek, Zeven (DE); Jürgen Löhn, Zeven (DE)

(73) Assignee: MAPA GMBH, Zeven (DE)

( * ) Notice: Subject to any disclaimer, the term of this patent is extended or adjusted under 35 U.S.C. 154(b) by 0 days.

(21) Appl. No.: 16/487,716

(22) PCT Filed: Dec. 4, 2018

(86) PCT No.: PCT/DE2018/100989
§ 371 (c)(1),
(2) Date: Aug. 21, 2019

(87) PCT Pub. No.: WO2019/110052
PCT Pub. Date: Jun. 13, 2019

(65) Prior Publication Data

US 2020/0229625 A1 Jul. 23, 2020

(30) Foreign Application Priority Data

Dec. 4, 2017 (DE) ..... 10 2017 128 781.4
Jan. 25, 2018 (DE) ..... 10 2018 101 732.7

(51) Int. Cl.
*A47G 19/22* (2006.01)
*B65D 47/24* (2006.01)
*B65D 47/32* (2006.01)

(52) U.S. Cl.
CPC ..... *A47G 19/2272* (2013.01); *B65D 47/246* (2013.01); *B65D 47/32* (2013.01)

(58) Field of Classification Search
CPC ..... A47G 19/2272; A47G 19/2266; B65D 47/246; B65D 47/32
(Continued)

(56) References Cited

U.S. PATENT DOCUMENTS

2015/0102032 A1* 4/2015 Dunn ..... A47G 19/2272 220/231
2018/0008069 A1* 1/2018 Beltrami ..... B65D 53/02

FOREIGN PATENT DOCUMENTS

EP 2 265 152 B1 12/2010
WO 2015/057871 A1 4/2015

OTHER PUBLICATIONS

Search Report & Written Opinion issued in International Patent Application No. PCT/DE2018/100989, dated Mar. 22, 2019.

* cited by examiner

*Primary Examiner* — James N Smalley
*Assistant Examiner* — Madison L Poos
(74) *Attorney, Agent, or Firm* — Eversheds Sutherland (US) LLP

(57) ABSTRACT

A drinking attachment (10) for drinking vessels (12), comprising a funnel-like circumferential drinking rim (14), which is open towards the drinking vessel (12), having a fastening section (16) for fastening the drinking attachment (10) to an edge region of the drinking vessel surrounding an opening of the drinking vessel (12), and a bowl-shaped elastic sealing disc (20), which can be inserted into the drinking rim (14) for sealing the drinking rim (14), the sealing disc (20) abutting circumferentially against the drinking rim (14) in the region of the end of the drinking rim (19, which is free in the intended mounting state of the drinking attachment (10) on a drinking vessel (12), while forming an interstice (22), which is open towards the drinking vessel (12), and being designed in such a way that it can
(Continued)

be partially lifted from the drinking rim (14) by a suction action of a user of the drinking attachment (10), in order to open a passage to the interstice (22), the sealing disc (20) having in the region of its bottom an outwardly projecting circumferential flange (26), which is designed to come to rest on the edge surrounding the opening of the drinking vessel (12), the drinking rim (14) being provided with a clamping flange (32) projecting towards the sealing disc for clamping the flange (26) of the sealing disc (20) against the edge of the opening of the drinking vessel (12) upon fastening the drinking attachment (10) on a drinking vessel (12), wherein the flange (26) of the sealing disc (20) is provided with a number of openings (28) to the interstice (22) and wherein the clamping flange (32) ends in front of the openings (28) provided in the flange (26) of the sealing disc (20).

14 Claims, 3 Drawing Sheets

(58) Field of Classification Search
USPC ..... 220/203.16, 231, 254.8, 714; 215/11.5, 215/309, 311
See application file for complete search history.

DRINKING ATTACHMENT FOR A DRINKING VESSEL AND DRINKING VESSEL WITH SUCH ATTACHMENT

CROSS-REFERENCE TO RELATED APPLICATIONS

This application is a national stage application, filed under 35 U.S.C. § 371, of International Application No. PCT/DE2018/100989, filed on Dec. 4, 2018, which claims priority to German Patent Application No. 102017128781.7, filed on Dec. 4, 2017, and German Patent Application No. 102018101732.4, filed on Jan. 25, 2018, the entire contents of each of which are hereby incorporated herein by reference in their entirety for all purposes.

TECHNICAL FIELD OF THE INVENTION

The invention relates to a drinking attachment for a drinking vessel and a drinking vessel, such as in particular a drinking bottle or a drinking cup, with such an attachment, the drinking attachment allowing drinking from the drinking vessel without having to remove the drinking attachment from the vessel.

BACKGROUND TO THE INVENTION

Drinking attachments of the type in question have long been known in many different forms and regularly fulfil a dual function: on the one hand, they enable a user to consume a liquid contained in a drinking vessel fitted with such an attachment typically by lightly sucking it in; on the other hand, depending on the design, they prevent the liquid from leaking or at least from sloshing out of the drinking vessel. For this purpose, they regularly have at least one outlet for a liquid located in the drinking vessel, which outlet prevents at least partially the unhindered flow of liquid out of the drinking vessel, and a fastening section for fastening the drinking attachment to an edge region of the drinking vessel surrounding an opening of the drinking vessel, e.g. for screwing the drinking attachment onto or into a thread formed on the drinking vessel. Like the drinking attachment claimed here, they often include a sealing element for sealing the outlet.

Whereas such drinking attachments and drinking vessels provided therewith were formerly only used by certain groups of people respectively only for certain purposes, e.g. by cyclists in the form of sports drinking bottles, in the hospital and care sector in the form of feeding cups and by parents to feed babies and small children in the form of bottles with soother attachments, in recent years reusable drinking vessels, especially in the form of thermos cups, are enjoying increasing popularity because more and more people do not want to abstain from enjoying cold or hot drinks during activities such as driving a car or shopping.

A special category among the drinking attachments, which also includes the drinking attachment according to the invention, are the so-called 360° drinking attachments, which in English are sometimes also referred to as "non-spill drinking devices". They do not require elements such as nozzles, soothers or beaks and enable a user to drink in the same way as from a normal cup anywhere along a surrounding drinking rim (from which the name 360° drinking attachment derives). Such drinking attachments are known e.g. from WO 2015 057871 A1 and EP 2 265 152 B1.

With such 360° drinking attachments, drinking vessels equipped with them can be used practically like normal cups, i.e. when drinking the user brings the drinking rim to his mouth like the rim of a cup and then holds the drinking vessel at an angle. Liquid from the drinking vessel enters an interstice between the drinking rim and an elastic sealing disc, which is placed against the drinking rim in the area of the free end of the drinking rim. The sealing disc lifts off from the drinking rim when the user sucks on it slightly, so that the liquid from the drinking vessel can reach the mouth of the user.

Drinking vessels with 360° drinking attachments are often used to accustom children who have just left infancy to the use of normal cups, as the movements of bringing the drinking vessel to the mouth and holding it at an angle to drink are the same as for a normal cup without an attachment while there is practically no risk of spilling.

The two publications EP 2 265 152 B1 and WO 2015 057871 A1 mentioned above each teach different forms of drinking attachments, each of which has a substantially funnel-like circumferential drinking rim, which is at least partially open towards the drinking vessel, with a fastening section for fastening the drinking rim to an edge region of a drinking vessel surrounding an opening in the drinking vessel, and a substantially elastic so-called sealing disk, which can be inserted into the drinking rim for sealing the drinking rim, said sealing disc abutting circumferentially against the drinking rim in the region of the free end of the drinking rim, forming an interstice open towards the drinking vessel, and being formed such that it can be partially lifted from the drinking rim by a suction action of a user of the drinking attachment in order to open a passage to the interstice. At this point it should be pointed out that the sealing disc is usually referred to as a disc, but is in fact usually rather bowl-shaped in order to partially follow the shape of the funnel-like drinking rim while having a bottom closed towards the drinking vessel.

In most of the embodiments shown in the two publications mentioned above, the drinking rim has a bottom, which partially closes the opening of the drinking vessel and which is provided with a number of perforations in its edge area in order to allow liquid to flow out of the drinking vessel in a throttled manner. The sealing disc is connected to the bottom on the outside of the drinking vessel facing away from the drinking vessel, typically by means of a central mushroom-shaped stamp on the bottom and an opening in the elastic sealing disc, which is dimensioned so that it can be pulled by elastic deformation over a stamp head projecting from a cylindrical stamp stem and then abuts against the stamp stem. Alternatively, the sealing disc can be fitted with a mushroom-shaped stamp, which is inserted through a central opening in the bottom.

The edge of the sealing disc of the drinking attachments known from EP 2 265 152 B1 and WO 2015 057871 A1 is designed in such a way that its outermost part abuts closely to the drinking rim, but increasingly moves away from the drinking rim towards the perforations in the bottom of the drinking rim, so that the interstice is formed, in which liquid can enter.

However, it has turned out that children often play with the sealing disc and pull it off form the bottom, so that liquid can then escape from the drinking vessel again almost unhindered. In order to partially solve this problem, WO 2015 057871 A1 shows an embodiment, in which the sealing disc has, in the area of its bottom, a circumferential flange projecting outwardly, which is designed to abut on the edge surrounding the opening of the drinking vessel in order to be clamped there by means of a clamping flange projecting from the drinking rim to the sealing disc. In order to allow the liquid to pass through to the interstice, both flanges have apertures, which must be aligned during assembly. It has turned out that the alignment of the perforations of both flanges, which is necessary after each cleaning of the drinking attachment, is extremely laborious and is often not done with the necessary precision, so that the perforations overlap only partially and liquid is throttled too much when drinking. Users therefore try to avoid disassembling the drinking attachment, although this would be desirable to achieve an optimal cleaning result.

Another problem is the supply of air into the drinking vessel while drinking. If liquid is removed, air must be able to enter the drinking vessel to prevent the formation of a negative pressure in the drinking vessel, which would impede the removal of the liquid. The achieve this, the known drinking attachments usually have incisions, which however are not optimal in different respects. For example, the making of incisions requires at least one additional manufacturing step and the incisions only open at a certain negative pressure, so that a certain pulsation of the liquid flow can occur during the removal of liquid.

DISCLOSURE OF THE INVENTION

It is an object of the invention to disclose a 360° drinking attachment with improved properties, which in particular simplifies assembly after cleaning the drinking attachment.

The task is solved by a drinking vessel with the features of claim 1. Independent claim 13 concerns a drinking vessel with such a drinking attachment.

Amongst others, the invention has the advantage that upon assembling the sealing disk and the drinking rim, it is not necessary to pay attention to a special alignment of the components with respect to each other. In addition, production is simplified, as the clamping flange does not have to be provided with apertures in accordance with the invention, which also brings cost advantages.

In a preferred embodiment, the sealing disc is provided with a number of stiffening ribs between the openings, which has several advantages. For example, the stiffening ribs stiffen the sealing disc in the area of the flange, which is typically made of a soft material such as silicone, so that after it is clamped between the upper edge of the opening in the drinking vessel and the clamping flange, the flange sits securely and cannot be pulled out without further ado. Depending on the design of the stiffening ribs, these can also provide additional form-fitting support for the sealing disc on the inside of the drinking vessel. For this purpose, the ribs are preferably arranged on the side of the sealing disc facing the drinking vessel in the intended mounting condition.

For certain applications it may be advantageous to make the drinking rim in one piece from a suitable plastic material such as a stiffer TPU or PP. In particular, if the opening of the drinking vessel to be provided with a drinking attachment in accordance with the invention has a large diameter, it may be advantageous to assemble the drinking rim from two or more separate parts. This makes it possible to use different materials for the fastening section and a drinking section that comes into contact with a user's mouth when drinking, and in particular to choose a stiffer material for the fastening section than for the drinking section, which can lead to a more pleasant drinking experience. Advantageously the invention allows the expert in the art to choose the optimal design for the respective customer requirements.

In order to prevent a negative pressure from forming in the drinking vessel during drinking, which would hinder the discharge of further liquid, the drinking attachment can be equipped with means automatically ensuring an inflow of air above a certain negative pressure, e.g. a slot seal formed in the bottom of the sealing disc. In particularly preferred embodiments, an air inlet passage is formed between the drinking rim and the sealing disc. This air inlet passage can be formed in particular in the area of the sealing disc, which abuts circumferentially against the free end of the drinking rim. If the fastening section has an internal thread for screwing onto a corresponding external thread of a drinking vessel, an air inlet passage can alternatively or additionally be formed between the external thread and the internal thread.

The optional air inlet passages between the drinking rim and sealing disc and/or between the external thread and the internal thread can, for example, be provided as a circumferential thread groove or circumferential thread projection or as a so-called labyrinth-type or gap-type seal and may be designed in such way that air can always pass through, but drinks such as water, tea, milk cannot. Labyrinth or thread turns lengthen the flow path and increase the flow resistance, so that air can flow into the drinking vessel, but compared to air higher viscous liquid can not escape through the air inlet passages between the threads. It goes without saying that the passages referred to here as air intake passages can also allow air to escape from the vessel in order to prevent creation of an overpressure in the vessel for example when hot drinks have been filled in or when the filled vessel is taken into the mountains.

Further details and advantages of the invention will become apparent from the following purely exemplary and non-restrictive description of embodiments in conjunction with the drawing, which comprises six drawing figures.

DESCRIPTION OF PREFERRED EMBODIMENTS

Figure 1:
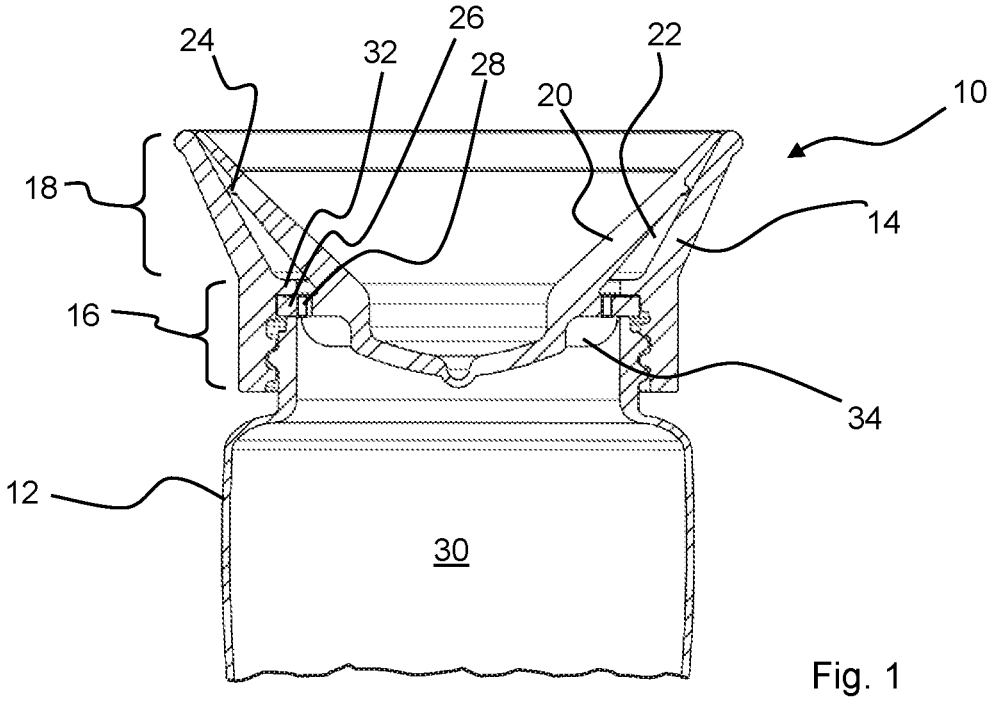
FIG. 1 shows a sectional view through a first embodiment of a drinking attachment according to the invention mounted on a drinking vessel.

FIG. 1 shows a sectional view through a drinking attachment according to the invention designated in its entirety by 10 and the upper portion of a corresponding drinking vessel 12, here in the form of a drinking bottle, which is provided on its edge region surrounding the opening with an external thread onto which the drinking attachment 10 is screwed in the depicted condition. For this purpose, the drinking attachment 10 has a drinking rim 14 with a fastening section 16 with an internal thread that is partially complementary to the external thread of the drinking bottle 12.

In this embodiment, the fastening section 16 merges into a funnel-shaped drinking section 18 integrally formed therewith, which is open towards the drinking vessel.

Inserted in the drinking rim 14 is an essentially bowl-shaped elastic sealing disc 20, which abuts against the drinking rim 14, or more precisely against the drinking section 18 in the area of its free end, in a circumferential manner, forming an interstice 22 open towards the drinking vessel 12. The term "free end" here refers to the end or the end region that faces the user when mounted on a drinking vessel.

The sealing disc 20 is designed in a manner known per se in such a way that it can be partially lifted from the drinking rim 14 respectively from the drinking section 18 by a suction action of a user of the drinking attachment, so that a passage to the interstice 22 is opened for the user. This lifting is facilitated by a number of nubs 24, which in this example are formed on the side of the sealing disc 20 facing the drinking section 18. It goes without saying that these nubs can also be formed on the drinking rim or drinking section. Instead of nubs, other suitable spacers can also be provided, e.g. short rib-like projections.

The sealing disc 20 is in the area of its bottom further provided with a circumferential flange 26 projecting outwards, which is designed to come to rest on the edge surrounding the opening of the drinking vessel 12. This flange 26 is provided with a number of openings 28 connecting the interstice 22 with the inner space 30 of the drinking vessel 12.

The flange 26 interacts with a circumferential clamping flange 32 protruding from the drinking rim 14 to the sealing disc 20 in the transition area between fastening section 16 and drinking section 18. The clamping flange 32 can be formed on the drinking section 18 or on the fastening section 16 or be present as a component arranged between the fastening section 16 and the drinking section 18.

A special feature according to the invention is that this clamping flange 32 ends before the openings 28 provided in the flange 26 of the sealing disc 20 and thus does not obstruct the passage of liquid from the drinking vessel 12 through the openings 28 into the interstice 22 and from there into the mouth of the user when drinking. The sealing disc can also be inserted into the drinking rim 14 without having to pay attention to a special alignment of the openings 28 to any openings on the drinking rim side. When screwing the drinking attachment 10 onto the drinking vessel 12, the sealing disc 20 is reliably secured by means of the clamping flange 32.

In this embodiment, the sealing disc 20 *also has a number of stiffening ribs 34, which are formed in the bottom area of the sealing disc 20 in such a way that each lies lie between two openings 28 respectively. The stiffening ribs 34 ensure advantageously that even when children play with the sealing disc 20 while drinking, it cannot simply be pulled out of the clamping between the clamping flange 32 and the upper edge of the opening of the drinking vessel 12.

Figure 2:
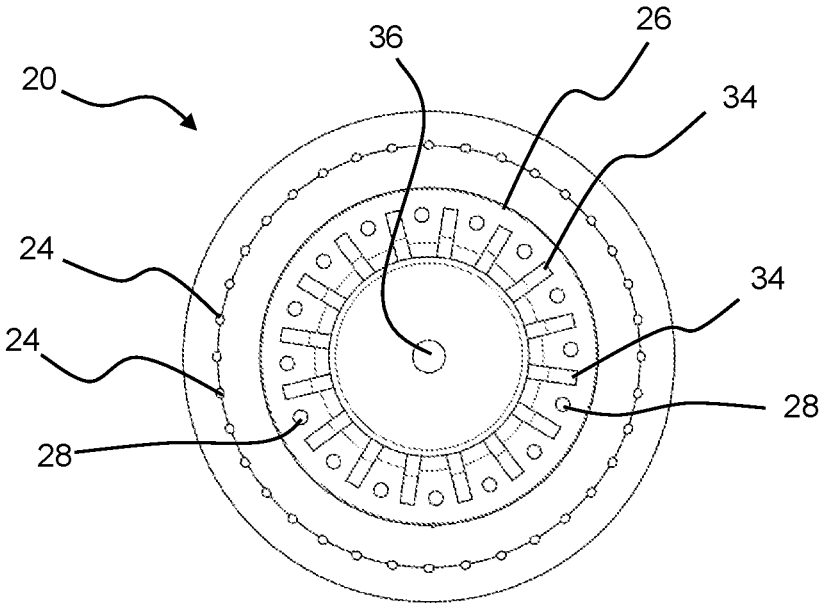
FIG. 2 shows a plan view of the side of the sealing disk of the embodiment according to FIG. 1, which in the intended mounting condition faces the drinking vessel.

FIG. 2 shows a plan view of the side of the sealing disc 20 facing the inner space of a drinking vessel when installed as intended. The spacers designed as nubs 24 and the openings 28 formed in the flange 26 as well as the stiffening ribs 34 formed on the sealing disc 20 can be clearly seen, whereby for reasons of clarity only a few of the nubs, the openings and the stiffening ribs were provided with reference signs. Depending on the design of the drinking attachment, it is advantageous to provide the central area 36 of the sealing disc 20 with a slot seal, i.e. to cut it diagonally or in a stepped manner such that a slot is formed between two slot flaps, which is closed in the initial state but through which air can flow in when a negative pressure is created in the inner space of the vessel by the removal of liquid upon drinking, because the slot flaps open. However, in the embodiments shown here, the flow of air into the inner space of the vessel is ensured by an air inlet passage acting in the manner of a labyrinth-type seal, which will be described later.

Figure 3:
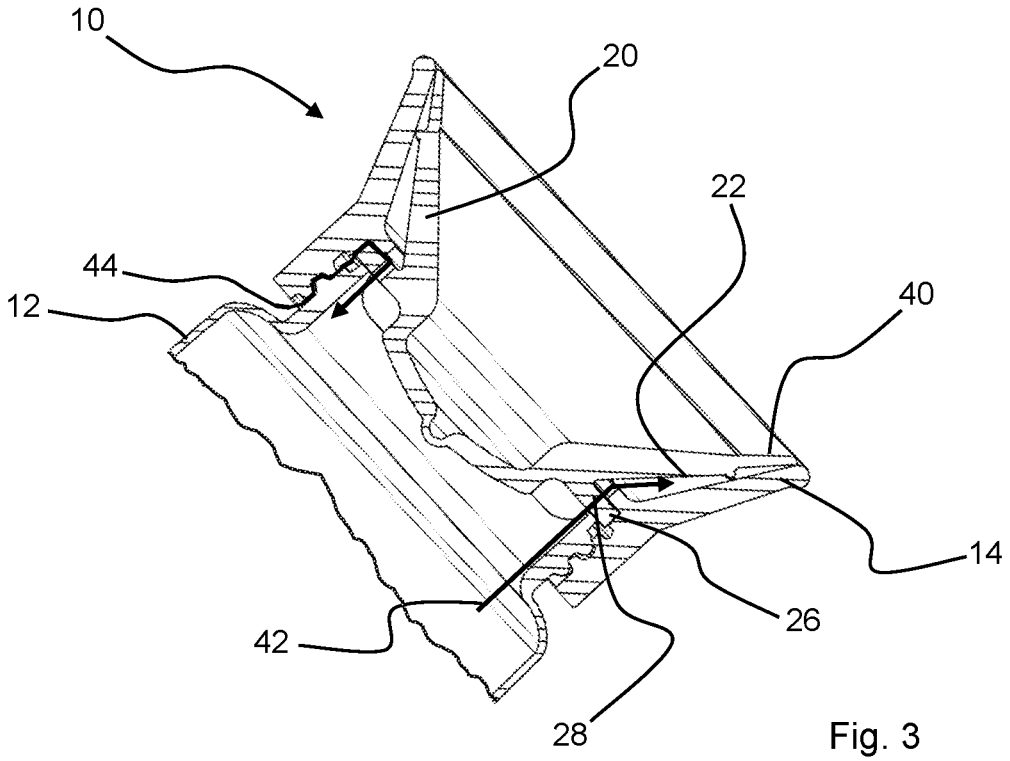
FIG. 3 shows schematically the flow processes when using the drinking attachment according to FIG. 1.

FIG. 3 shows a drinking attachment 10 and a part of a drinking vessel 12 according to FIG. 1 in a drinking situation. Not shown is a user who can easily detach the sealing disc 20 from the drinking rim 14 by lightly sucking on the area of section 40 of the sealing disc 20, whereby, through holding at an angle, liquid can then flow through the openings 28 in the flange 26 of the sealing disc 20 into the interstice 22 as indicated by arrow 42 and from there into the mouth of a user. In order to prevent the creation of a negative pressure in the drinking vessel, which would impede the outflow of liquid, the internal thread of the drinking rim 14 is designed in such manner that between the internal thread and the external thread of the drinking vessel 12 an air inlet passage is created, which acts like a labyrinth-type seal, through which air can flow into the vessel as indicated by arrow 44, without there being any danger that liquid, which is more viscous than air, could escape. The arrow must be understood as a schematic explanation. In fact, the air can follow the thread between the male and female threads, which are designed in such a way that their reciprocal flanks do not engage in a completely sealing manner.

Figure 4:
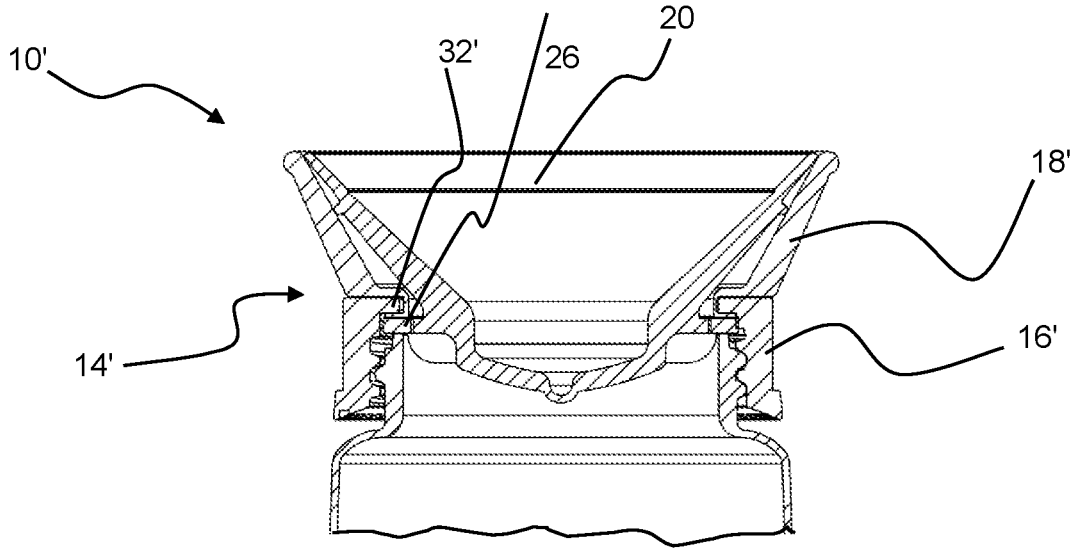
FIG. 4 shows a sectional view similar to FIG. 1 through a second embodiment of the drinking attachment, in which the fastening section and the drinking rim are formed by two parts.

FIG. 4 shows a second example of a drinking attachment designated in its entirety by 10' in a sectional view analogous to the view of FIG. 1 in a state mounted on a drinking vessel 12. The sealing disc 20 corresponds to the previously described sealing disc, so that a repeated description of it can be skipped. An essential difference to the embodiment shown in FIG. 1 is the two-part design of the drinking rim 14', in which the fastening section 16' and the drinking section 18' are formed by two separate components, which are latched together in this embodiment, for which purpose the drinking section 18' has a receptacle for the clamping flange 32' integrally formed on the fastening section 16', which receptacle encompasses the same to such an extent that a part of the drinking section 18' lies between the clamping flange 32' and the flange 26 of the sealing disc 20 when the sealing disc 20 is inserted as intended into the drinking rim 14'. This embodiment advantageously allows choosing a different material for the drinking rim 18', in particular a softer material than for the fastening section 16', which can lead to a particularly pleasant drinking feeling.

Figure 5:
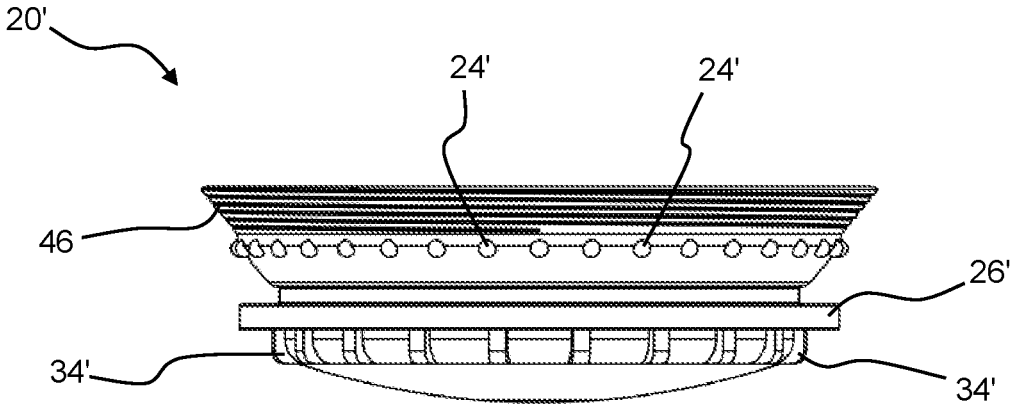
FIG. 5 shows another version of an invented sealing disc in side view.
Figure 6:
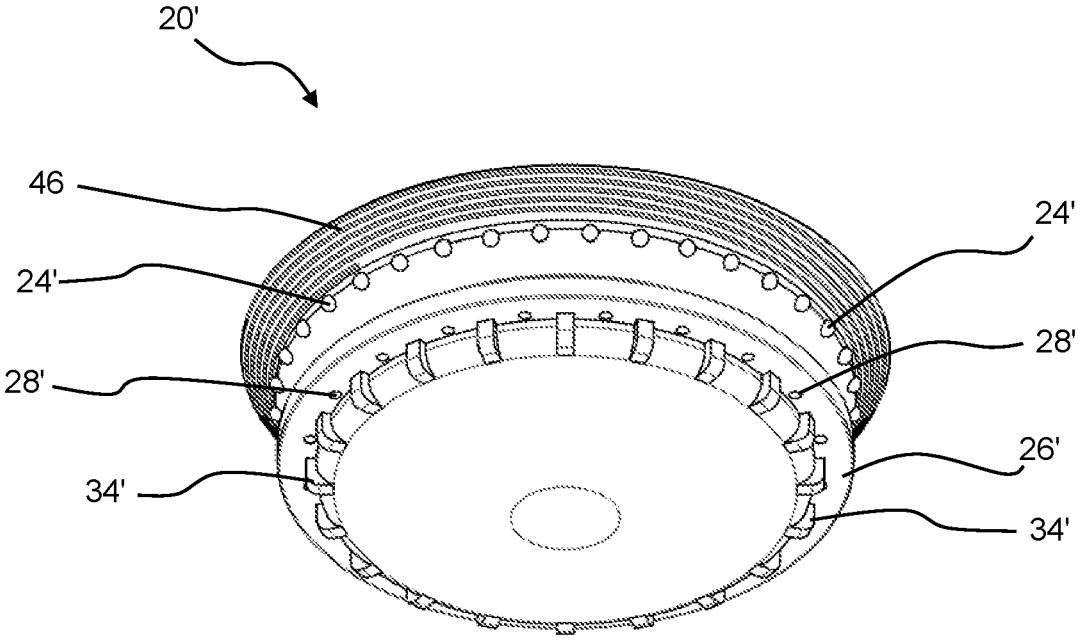
FIG. 6 shows the sealing disc according to FIG. 5 in a perspective view diagonally from below.

FIGS. 5 and 6 show another embodiment of a sealing disc 20' according to the invention, which essentially corresponds to the sealing disc 20 already described above, so that a detailed repetition of the corresponding description can be skipped. This sealing disc also has a number of stiffening ribs 34', a flange 26' in which a number of openings 28' are formed, and nubs 24', which facilitate the lifting of the sealing disc area, which, when assembled as intended, abuts against the drinking rim in the area of its free end.

A special feature of this embodiment is the thread 46, which is provided in the sealing disc's area, which in the intended mounting state abuts circumferentially against the free end of the drinking rim forming an air inlet passage and, by extending the flow path, enables air to flow into and out of the drinking vessel, while liquids are prevented from escaping the vessel via the passage thus formed. Thread 46 can be designed as a circumferential thread groove or as a circumferential thread projection. The area of the drinking rim against which the thread 46 rests is even. It goes without saying that instead of the thread 46 shown, it is also possible to provide labyrinth-type threads or otherwise shaped threads, as long as these achieve the desired effect. An advantage of the air inlet passages formed in such way is that they can be produced directly during the manufacture of the sealing discs or, if an air inlet passage is provided between an external thread of a drinking vessel and an internal thread of a fastening section, during the manufacture of the vessel and/or the fastening section, without requiring a separate machining or manufacturing step.

Within the scope of the inventive idea, numerous modifications and further variations are possible, which concern e.g. the design of the clamping flange on the drinking rim and the flange on the sealing disc. Instead of the round openings shown, elongated slotted openings can also be provided in the flange of the sealing disc. Instead of the shown stiffening ribs, it is also possible to provide a circumferential bead and to provide it with openings to the interstice between the sealing disc and the drinking section.

LIST OF REFERENCE NUMBERS

10, 10' drinking attachment
12 drinking vessel
14, 14' drinking rim
16, 16' fastening section
18, 18' drinking section
20, 20' sealing disc
22 interstice
24, 24' nub
26, 26' flange
28, 28' opening
30 inner space of vessel
32, 32' clamping flange
34, 34' stiffening rib
36 center region of sealing disc
40 section of the sealing disc
42 flow arrow
44 flow arrow
46 thread (air inlet passage)

The invention claimed is:

1. A drinking attachment for a drinking vessel comprising:

a funnel-like circumferential drinking rim, which is open towards the drinking vessel, having a fastening section for fastening the drinking attachment to an edge region of the drinking vessel surrounding an opening of the drinking vessel, and a bowl-shaped elastic sealing disc, insertable into the drinking rim to seal the drinking rim, wherein an air inlet passage is formed between the drinking rim and the sealing disc, and is further formed in a region of the sealing disc that abuts circumferentially against the end of the drinking rim, wherein the sealing disc abuts circumferentially against the drinking rim in the region of an end of the drinking rim, which is free in the intended mounting state of the drinking attachment on the drinking vessel, forming an interstice open towards the drinking vessel, and is formed so that the sealing disc can be partially lifted from the drinking rim by a suction action of a user of the drinking attachment in order to open a passage to the interstice, wherein a bottom area of the sealing disc has an outwardly projecting circumferential flange, which is designed to come to rest on an edge surrounding the opening of the drinking vessel, wherein the drinking rim comprises a clamping flange projecting towards the sealing disc to clamp the flange of the sealing disc against the rim of the opening of the drinking vessel when attaching the drinking attachment to the drinking vessel, wherein the flange of the sealing disc comprises a plurality of openings to the interstice, and wherein the clamping flange ends in front of the openings provided in the flange of the sealing disc.

2. The drinking attachment according to claim 1, wherein the sealing disc is provided with a plurality of stiffening ribs, each of the plurality of stiffening ribs being provided between a pair of the plurality of openings.

3. The drinking attachment according to claim 2, wherein the ribs are arranged on a side of the sealing disc facing the drinking vessel in an intended mounting state.

4. The drinking attachment according to claim 1, wherein the fastening section is integrally formed on the drinking rim.

5. The drinking attachment according to claim 1, wherein the drinking rim comprises at least two separate components, one of the at least two separate components forming the fastening section.

6. The drinking attachment according to claim 5, wherein the drinking rim has a drinking section made of silicone, thermoplastic elastomers (TPE), thermoplastic polyurethane (TPU), or polypropylene (PP).

7. The drinking attachment according to claim 6, wherein the fastening section is made of a material having a higher stiffness than the drinking section.

8. The drinking attachment according to claim 1, wherein the sealing disc is made of silicone.

9. The drinking attachment according to claim 1, wherein the fastening section has an internal thread configured to be screwed onto a corresponding external thread of the drinking vessel.

10. The drinking attachment according to claim 9, wherein the fastening section is designed in such a way that an air inlet passage is formed between the external thread and the internal thread.

11. The drinking attachment according to claim 1, wherein the air inlet passage between the drinking rim and the sealing disc is constructed in the form of a circumferential thread or as a gap-type or a labyrinth-type seal.

12. The drinking attachment according to claim 1, wherein the sealing disc has a slot-type seal in the bottom area of the sealing disc.

13. A drinking vessel with a drinking attachment according to claim 1.

14. The drinking attachment according to claim 10, wherein the air inlet passage between the external thread and the internal thread is constructed in the form of a circumferential thread or as a gap-type or a labyrinth-type seal.

* * * * *